US005100309A

United States Patent [19]

Eiermann et al.

[11] Patent Number: 5,100,309

[45] Date of Patent: Mar. 31, 1992

[54] COOLING MEDIUM PUMP OF A ROTARY PISTON INTERNAL COMBUSTION ENGINE

[75] Inventors: Dankwart Eiermann, Weissensberg; Roland Nuber, Lindau, both of Fed. Rep. of Germany

[73] Assignee: Wankel GmbH, Berlin, Fed. Rep. of Germany

[21] Appl. No.: 525,095

[22] Filed: May 17, 1990

[30] Foreign Application Priority Data

Nov. 17, 1989 [DE] Fed. Rep. of Germany ..... 3938331

[51] Int. Cl.[5] ..... F01C 21/06

[52] U.S. Cl. ..... 418/61.2; 418/84; 418/88

[58] Field of Search ..... 418/84, 85, 87, 88, 418/61.2, 43; 417/423.6, 319; 415/122.1, 104, 107

[56] References Cited

U.S. PATENT DOCUMENTS

| | | | |
|---|---|---|---|
| 2,402,972 | 7/1946 | Mitchell | 418/43 |
| 3,151,807 | 10/1964 | Froede | 418/61.2 |
| 3,257,913 | 6/1966 | Broom et al. | 418/43 |
| 3,405,693 | 10/1968 | Sparrow | 418/61.2 |
| 4,797,074 | 1/1989 | Albert | 418/43 |
| 4,826,410 | 5/1989 | Yamamoto et al. | 418/84 |

*Primary Examiner*—Leonard E. Smith
*Assistant Examiner*—David L. Cavanaugh
*Attorney, Agent, or Firm*—Robert W. Becker & Associates

[57] ABSTRACT

An arrangement of a cooling medium pump of a rotary piston internal combustion engine of trochoidal-type of construction with a fluid or liquid cooled housing, with which the cooling medium is conveyed first in common and parallel through cooling hollow chambers of the casing mantle part and of a side part in a common hollow chamber and from there is conveyed by way of a cooling medium pump into another side part and from there via a thermostat into a cooler arranged on the other side part and from there it is returned into the cooling medium circulation in the housing. The cooling medium pump is arranged in the casing mantle part and a propeller or impeller thereof is arranged in a cooling hollow chamber of the other side part. A speed of rotation control regulator is arranged on a shaft of the cooling medium pump for fresh air supply and a lubricating oil pump also can be arranged on a butt end of this shaft.

3 Claims, 2 Drawing Sheets

COOLING MEDIUM PUMP OF A ROTARY PISTON INTERNAL COMBUSTION ENGINE

BACKGROUND OF THE INVENTION

1. Field of the Invention

The present invention relates to an arrangement of a cooling medium or cooling-water pump of a rotary piston internal combustion engine having a housing consisting of two side parts and a casing mantle part with a trochoidal-shaped dual-arc casing mantle runway inner surfacing, the housing being arranged for fluid or liquid cooling thereof. An eccentric shaft extends through the housing as mounted or journalled by the two side parts. An eccentric on the eccentric shaft has a triangular piston including corners thereof in continuous engagement along the casing mantle runway inner surfacing and controlled by a synchronous transmission.

2. Description of the Prior Art

A pump required for circulation of liquid or fluid cooling medium or cooling water conventionally is arranged externally of a machine housing. With small machines as for example with machines employed for lawn mowers, tree saws for cutting wood, rippling or pruning as well as industrial motors there are encountered space difficulties for accommodation of a cooling fluid or medium pump, for a speed of rotation regulator or control and the oil or lubricating pump.

SUMMARY OF THE INVENTION

An object of the present invention is to provide a constructive arrangement to resolve space difficulties with small machines having a closed and compact outer shape without requiring any attachments which would cause any disturbance during utilization of the small machines.

BRIEF DESCRIPTION OF THE DRAWINGS

This object, and other objects and advantages of the present invention will appear more clearly from the following specification in conjunction accompanying drawings, in which.

DESCRIPTION OF THE PREFERRED EMBODIMENTS

Figure 1:
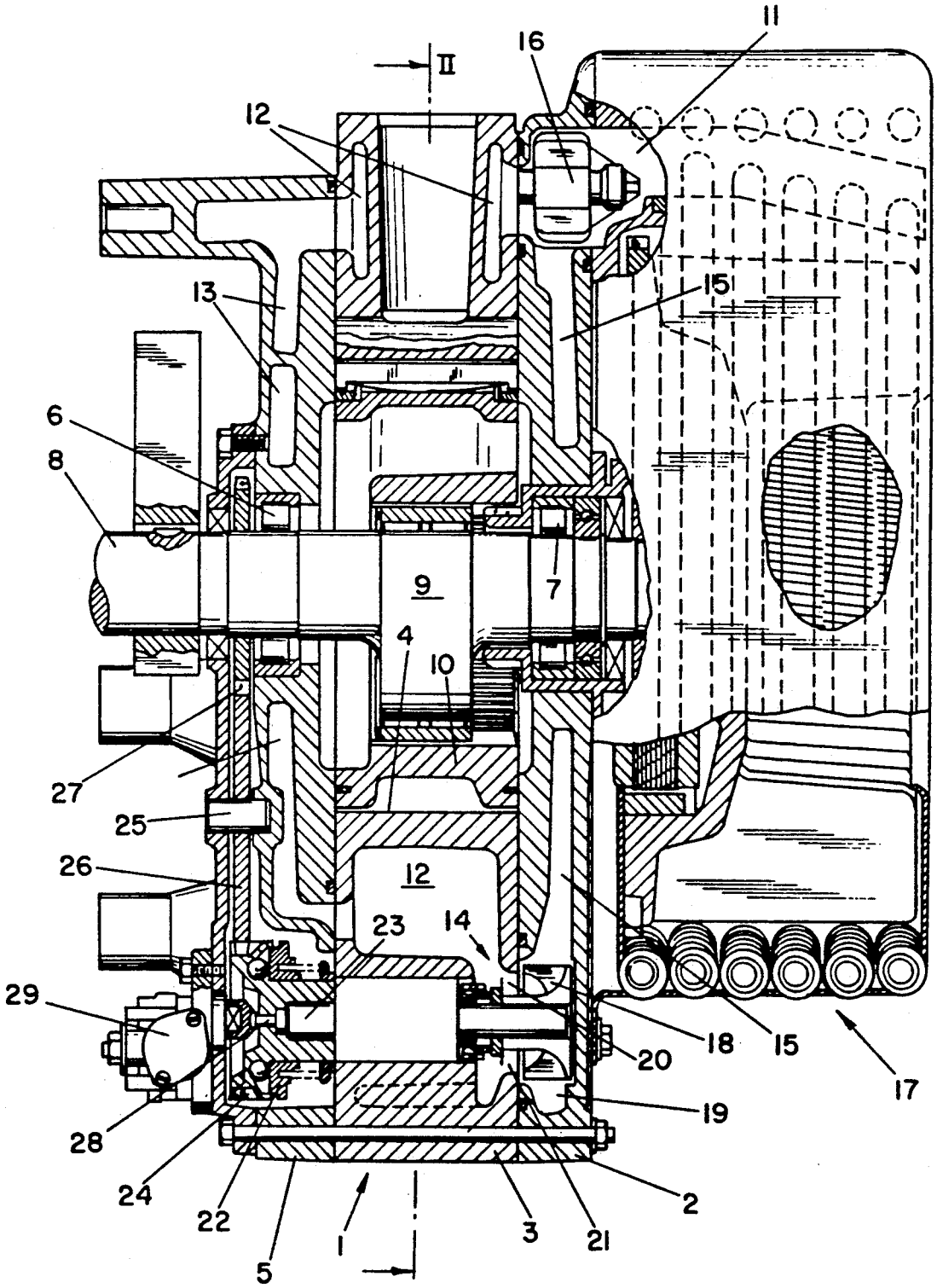
FIG. 1 is a view which is an axial section taken along a line I—I in a plane of FIG. 2 through a machine having features in accordance with the present invention.
Figure 2:
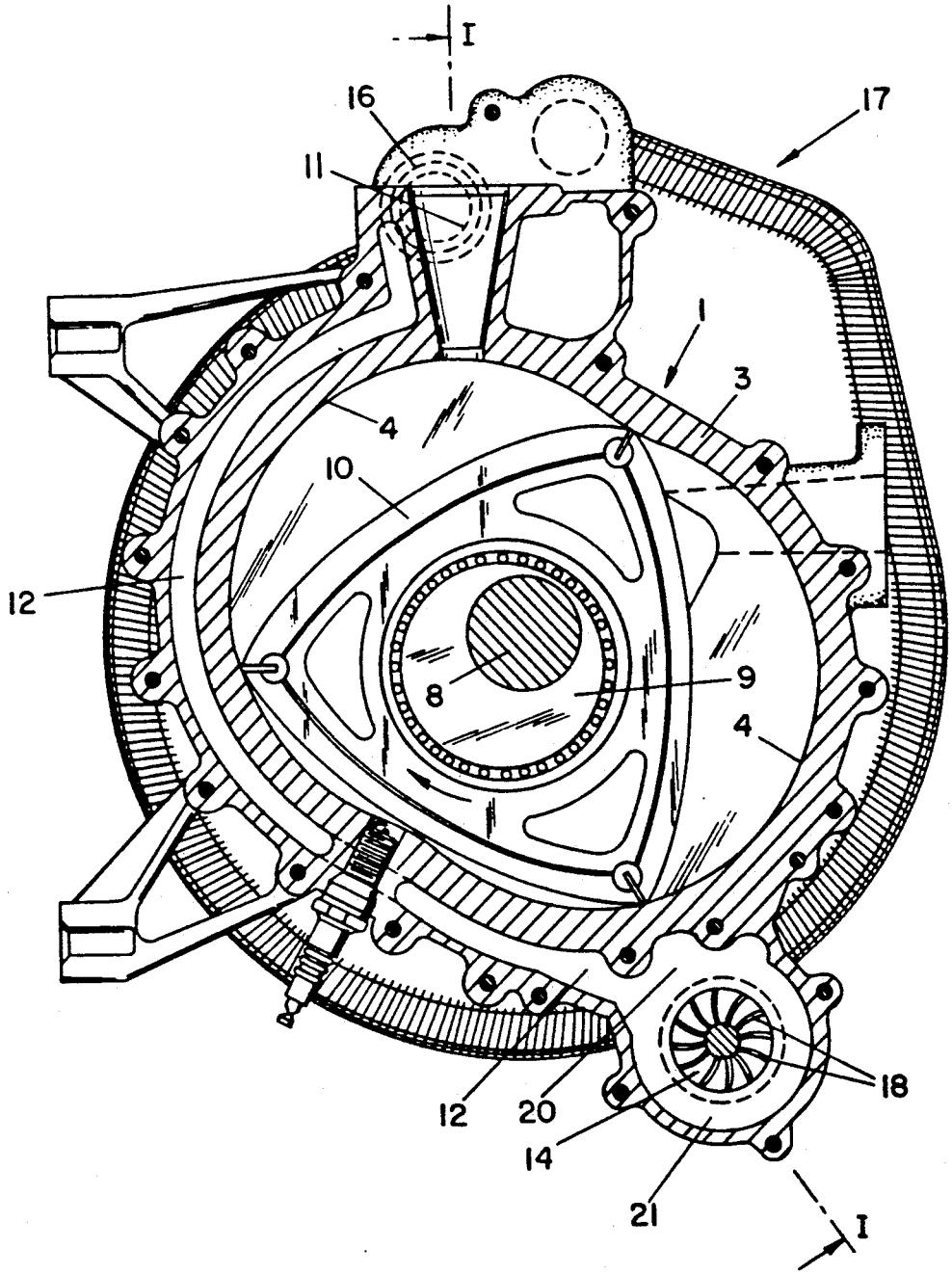
FIG. 2 is a view that shows a radial section taken along a line II—II in a plane through the same machine with respect to FIG. 1.

Referring now to the drawings in detail, the internal combustion machine illustrated in the drawings has a housing 1 which is formed of an upper side plate 2, a casing mantle part with a trochoidal-shaped casing mantle runway inner surfacing 4 and a lower side part 5. An eccentric shaft is journalled by bearing means 6 and 7 mounted in the side parts 1 and 2. An eccentric on the eccentric shaft 8 has a triangular piston 9 thereon which rotates with corner sealing parts thereof in continuous engagement along the casing mantle runway inner surfacing 4 in a planetary movement.

The cooling medium or cooling water flows as it comes from a collecting line or conduit to pass through cooling hollow chamber means 12 of the casing mantle part 3 and through the cooling hollow chambers 13 of the lower side part 5, such cooling hollow chambers 13 being connected in parallel with the cooling hollow chambers 12. The cooling medium or cooling water is conveyed from there by a cooling medium pump 14 into the cooling hollow chamber 15 of the upper side part 2. The cooling medium passes either directly or according to switching open via a thermostat 16 by way of a cooler 17 back into the cooling hollow chambers 12 and 13.

The cooling medium pump 14 is arranged in a bore of the casing mantle part 3 at a location to the right in the drawing. The impeller or propeller 18 of the cooling medium pump 14 projects into a hollow space or chamber 19 in the upper side part 2. Supply lines 20 and 21 from the casing mantle part 3 open into the hollow space or chamber 19 and these supply lines 20 and 21 themselves are connected in communication with the cooling hollow chambers 13 of the lower side part 5.

A speed of rotation control or regulator 22 is fastened on a shaft butt or end 23 of the cooling medium pump 14 projecting from the lower side part 5. The gear or drive wheel 24 of the speed of rotation control or regulator 22 meshes upon the lower side of the lower side part 5 with an idler or intermediate gear or wheel 26 arranged on a shaft butt or end 25 stationary or fixed in the side part 5. The intermediate gear or wheel is driven by a gear or toothed wheel 27 wedged or keyed on the eccentric shaft 8. The shaft butt or end 23 of the cooling medium pump 14 has an extension turned to a smaller diameter and this extension 28 passes axially through the speed of rotation control or regulator 22 and drives a small single cylinder swash-plate or wobbler plate pump 29 for oil dosage and distribution.

The cooling medium pump 14 and the speed of rotation control or regulator 22 are located within the outer contour of the housing 1. The oil dosage pump is located within the base feet which are provided on the underside of the lower side part 5.

There is noted that the present inventive internal combustion engine can be employed both with the shaft 8 thereof located horizontally as well as standing in a vertical or upright positioning and for this reason the shaft bearing means 7 can be provided to be both axial- and radial bearing means.

The present inventive arrangement includes a cooling medium pump for a rotary piston internal combustion engine of trochoidal-type of construction with a fluid or liquid cooled housing 1, with which the cooling medium first is conveyed in common and parallel through cooling hollow chambers 12, 13 of the casing mantle part 3 and one side part 5 into a common hollow space or chamber and from there by means of the cooling medium pump 14 into the other side part 2 and from there via a thermostat 16 into a cooler 17 arranged on the other side part 2 and from there being returned into the cooling medium circulation in the housing 1. The cooling medium pump 14 is arranged in the casing mantle part 3 and a propeller or impeller 18 thereof is located in a cooling hollow chamber 19 of the other side part 2. A speed of rotation control regulator 22 for the fresh air supply can be arranged on the shaft thereof and also a lubricating oil pump 29 can be arranged on a shaft thereof. Reference can be made to FIG. 1 of the drawings.

The arrangement of a cooling medium pump of a rotary piston internal combustion engine includes a housing which is fluid or liquid cooled and consists of two side parts and a casing mantle part with a trochoidal-shaped dual-arc casing mantle runway inner surfacing. An eccentric shaft 8 passes through the housing and is journalled by the side parts 2 and 5 of the housing 1. An eccentric has a triangular piston 9 thereon controlled by a synchronous drive transmission means with corners of the triangular piston running along the casing mantle raceway inner surfacing with continuous sliding engagement therewith. The cooling hollow chambers 12 of the casing mantle part 3 and the cooling hollow chambers 13 of the side part 5 remote from a cooler 17 have cooling medium flow supplied parallel in common and opening in common into a hollow space or chamber 19 in the upper side part 2 adjoining the cooler 17. A propeller or vane/blade impeller wheel 18 of a cooling medium pump 14 rotates in this hollow chamber 19. The cooling medium pump 14 is arranged in a bore in the casing part 3. Furthermore a thermostat 16 is arranged in the upper side part 2 toward the cooler 17. The return flow of the cooling medium to the cooler 17 occurs by way of the thermostat 16 as to the cooler 17 or to the casing mantle part 3 and the other lower side part 5. A shaft butt end 23 of the cooling medium pump 14 has a speed of rotation control regulator 22 securely or rigidly arranged thereon in a location of the side part 5 away from or remote from the cooler 17. The speed of rotation control regulator 22 in turn has a drive wheel or gear 24 which meshes with an intermediate gear 26 rotating on a shaft butt end 25 provided in the same side part 5. The intermediate gear 26 is driven by a gear 27 pressed, wedged or keyed onto the eccentric shaft 8. The arrangement of the cooling medium or cooling-water pump furthermore has an extension of the cooling medium pump 14 passing through the speed of rotation control regulator 22 and also can have an oil or lubricating pump 29 arranged on this shaft stump end for the lubricating oil supply of the machine.

The present invention is, of course, in no way restricted to the specific disclosure of the specification and drawings, but also encompasses any modifications within the scope of the appended claims.

What is claimed is:

1. An arrangement of a cooling medium pump of a rotary piston internal combustion engine with a housing consisting of two side parts and a casing mantle part with a trochoidal-shaped dual-arc casing mantle runway surfacing with liquid cooling and having an eccentric shaft passing through said housing as journalled and mounted by said two side parts as well as having an eccentric on said eccentric shaft carrying a triangular piston with corners thereof continuously in sliding engagement along said casing mantle runway surfacing as well as being controlled by a synchronous transmission, the improvement comprising:

a cooling medium pump having a shaft and being arranged in a bore of said casing mantle part;

a cooler arranged adjacent to a first one of said side parts for a cooling medium to flow therethrough;

means forming cooling hollow chambers in said casing mantle part as well as cooling hollow chambers in said first side part and in a second one of said side parts that is arranged at an end of said casing mantle part opposite said cooler, with said cooler being in communication with said cooling hallow chambers of said casing mantle part and of said first and second side parts, with said cooling hollow chambers of said second side part and said cooling hollow chambers of said casing mantel part being connected in parallel to one another, with common supply lines connecting said parallel cooling hollow chambers to an cooling hollow chambers of said first side part, and with said impeller of said cooling medium group being disposed at an end of said supply lines in a hollow space of said cooling hollow chamber of said first side part for conveying a cooling medium from said cooling hollow chambers of said casing mantel part and of said second side part to said cooling hollow chambers of said first side part;

and a thermostat arranged in said first side part, via which a return flow of cooling medium to said cooler as well as to said casing mantle part and said second side part can occur.

2. An arrangement of a cooling medium pump according to claim 1, in which a speed of rotation control regulator is rigidly arranged stationary on a shaft butt end of the cooling medium pump on a side part remote from the cooler, said speed of rotation control regulator having a drive gear which meshes with an intermediate gear rotating upon a further shaft butt end provided in the same side part and which is driven by a toothed gear securely connected on the eccentric shaft.

3. An arrangement of a cooling medium pump according to claim 2, in which an extension of one of the shaft butt ends of the cooling medium pump passes through the speed of rotation control regulator and has an oil pump arranged thereon for the lubricating oil supply of the machine.

* * * * *